US010403975B2

(12) United States Patent
Chauloux et al.

(10) Patent No.: US 10,403,975 B2
(45) Date of Patent: Sep. 3, 2019

(54) ANTENNA WITH MECHANICALLY RECONFIGURABLE RADIATION PATTERN

(71) Applicant: COMMISSARIAT A L'ENERGIE ATOMIQUE ET AUX ENERGIES ALTERNATIVES, Paris (FR)

(72) Inventors: Antoine Chauloux, Rennes (FR); Mohamed Himdi, Rennes (FR); Franck Colombel, Montfort sur Meu (FR); Antoine Jouade, Noyal Chatillon sur Seiche (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 146 days.

(21) Appl. No.: 15/506,902

(22) PCT Filed: Sep. 3, 2015

(86) PCT No.: PCT/EP2015/070104

§ 371 (c)(1),
(2) Date: Feb. 27, 2017

(87) PCT Pub. No.: WO2016/034656

PCT Pub. Date: Mar. 10, 2016

(65) Prior Publication Data

US 2017/0279193 A1 Sep. 28, 2017

(30) Foreign Application Priority Data

Sep. 4, 2014 (FR) ..... 14 58299

(51) Int. Cl.
*H01Q 9/00* (2006.01)
*H01Q 3/12* (2006.01)
(Continued)

(52) U.S. Cl.
CPC ..... *H01Q 3/12* (2013.01); *H01Q 1/22* (2013.01); *H01Q 1/36* (2013.01); *H01Q 3/01* (2013.01); *H01Q 9/28* (2013.01); *H01Q 13/02* (2013.01)

(58) Field of Classification Search
CPC .. H01Q 3/12; H01Q 1/22; H01Q 1/36; H01Q 13/02; H01Q 9/28
(Continued)

(56) References Cited

U.S. PATENT DOCUMENTS 3,189,850 A 6/1965 Walker
3,274,602 A 9/1966 Randall et al.
(Continued)

FOREIGN PATENT DOCUMENTS

FR 1 405 182 7/1965

OTHER PUBLICATIONS

International Search Report dated Nov. 18, 2015 in PCT/EP2015/070104 filed Sep. 3, 2015.
(Continued)

*Primary Examiner* — Huedung X Mancuso
(74) *Attorney, Agent, or Firm* — Oblon, McClelland, Maier & Neustadt, L.L.P.

(57) ABSTRACT

An antenna has a predetermined operating frequency, corresponding to a predetermined wavelength, and the antenna includes: a conductive sectoral horn including one open end built into a floorplan; short-circuited radiating slots, built into the floorplan, on either side of the open end; and conductive louvres, arranged above the slots and the open end, and configured to be deployed mechanically in a continuous manner to modify a radiation pattern of the antenna. The antenna can be, for example, used in stations for testing electromagnetic fields.

11 Claims, 7 Drawing Sheets

(51) Int. Cl.

| | |
|---|---|
| ***H01Q 3/01*** | (2006.01) |
| ***H01Q 13/02*** | (2006.01) |
| ***H01Q 1/22*** | (2006.01) |
| ***H01Q 1/36*** | (2006.01) |
| ***H01Q 9/28*** | (2006.01) |

(58) Field of Classification Search
USPC ..... 343/750
See application file for complete search history.

(56) References Cited

U.S. PATENT DOCUMENTS 5,754,144 A * 5/1998 McEwan ..... H01Q 13/02
343/786
6,031,504 A * 2/2000 McEwan ..... H01Q 1/525
343/772
8,421,677 B2 * 4/2013 Godard ..... G01R 29/0878
343/700 MS

OTHER PUBLICATIONS

French Search Report dated Jun. 2, 2015 in FR14 58299 filed Sep. 4, 2014.
U.S. Appl. No. 15/328,708, filed Jan. 24, 2017, Antoine Chauloux.

* cited by examiner

ANTENNA WITH MECHANICALLY RECONFIGURABLE RADIATION PATTERN

TECHNICAL FIELD

The present invention relates to an antenna with a reconfigurable radiation pattern.

It especially has applications in electromagnetic field test facilities.

Among the radioelectric characteristics of an antenna, the radiation control is of particular importance. Combining the capacity to illuminate a wide surface with the ability to focus energy in a preferred direction requires the development of an antenna of the type having a «reconfigurable radiation pattern». Moreover, within the scope of certain applications, this antenna must be provided with a high power handling. The aim of the present invention is to meet these criteria.

STATE OF PRIOR ART

Varying the radiation pattern of an antenna can be performed according to various methods. It is for example known to use a change in the characteristics specific to a radiating source by dielectric polarisation. It is also known to introduce active circuits providing, amongst other things, phase shifting or switching functions. Besides the need to implement electronic circuits potentially having a limited power handling, some of these techniques require a discontinuous reconfiguration of a radiation pattern.

DISCLOSURE OF THE INVENTION

The purpose of the present invention is to overcome these drawbacks.

Precisely, the object of the present invention is an antenna with a reconfigurable radiation pattern, having a predetermined operating frequency, corresponding to a predetermined wavelength, this antenna being characterised in that it comprises:

- an electrically conductive floorplan,
- an electrically conductive sectoral horn, having first and second open ends and flaring out from the first to the second open end, the second open end being built into the floorplan and having an elongated shape,
- short-circuited radiating slots, having an elongated shape, built into the floorplan, disposed on either side of the second open end, parallel thereto, and
- electrically conductive louvres, disposed above the slots and the second open end, and capable of being mechanically deployed in a continuous manner in order to modify the radiation pattern of the antenna.

Preferably, the slots have a depth substantially equal to a quarter of the predetermined wavelength.

Also preferably, the slots and the second open end have a length substantially equal to three times the predetermined wavelength.

According to a preferred embodiment of the antenna, subject matter of the invention, this antenna further comprises first grooves in the floorplan, between the radiating slots and the second open end.

In this case, the radiating slots and the first grooves preferably have substantially the same depth.

According to a preferred embodiment of the invention, each radiating slot is discontinuous and made up of a set of elongated elementary slots, spaced from each other.

Preferably, the length of each elementary slot is substantially equal to half the predetermined wavelength.

Preferably, the antenna, subject matter of the invention, further comprises second grooves in the floorplan, these second grooves connecting the elementary slots of a same radiating slot to each other.

Preferably, each of the second grooves has a length substantially equal to 1.5 times the predetermined wavelength.

The second grooves preferably have a depth substantially equal to a quarter of the predetermined wavelength.

According to an advantageous embodiment of the invention, the sectoral horn is folded and has a minimum radius of curvature, selected in order to maintain substantially constant the distribution of the phase of the electromagnetic field present in the second open end of the sectoral horn.

BRIEF DESCRIPTION OF THE DRAWINGS

The present invention will be better understood upon reading the description of exemplary implementations given below, by way of purely indicating and in no way limitating purpose, with reference to the accompanying drawings in which.

DETAILED DISCLOSURE OF PARTICULAR EMBODIMENTS

An exemplary antenna, subject matter of the invention is given thereafter. In this example (given by way of purely indicating and in no way limitating purpose), the antenna is sized to operate at a frequency F equal to 2.47 GHz. It is reminded that the predetermined wavelength $\lambda$, associated with this predetermined frequency F, is equal to c/F where c represents the speed of light in vacuum.

Furthermore, the radiation pattern of the antenna continuously varies in the vertical plane: the half-power aperture of the main lobe continuously varies from 20° to 70°. The radiation pattern in the horizontal plane remains, as for it, stable; and the corresponding half-power aperture of the main lobe is 30°.

The described antenna uses a sectoral horn, associated with radiating slots. Louvres mechanically move above the horn and the slots. This mechanical movement leads to the reconfiguration of the radiation pattern.

The whole structure of this antenna is made of an electrically conductive material, preferably a metal. Losses are thus limited and a potentially high power handling is given to the antenna, enabling it to withstand power levels in the order of 1 kW.

The antenna with a reconfigurable radiation pattern given by way of example will now be described in a detailed manner.

Figure 1A:
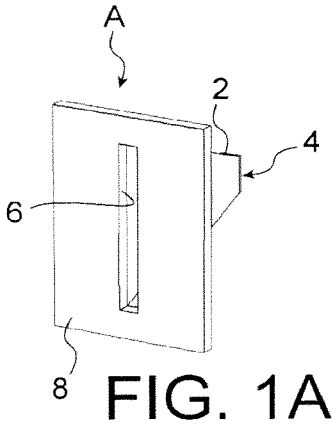
FIGS. 1A and 1B show an exemplary antenna, subject matter of the invention, comprising a sectoral horn the radiating aperture of which is built into a floorplan.
Figure 1B:
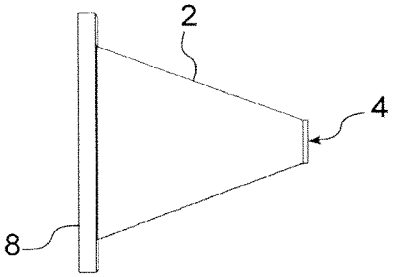

The radiating source that the antenna A includes is first considered. It first comprises a metallic sectoral horn 2 (FIGS. 1A and 1B) which is sized in order to obtain a half-power aperture of the main lobe, equal to 20° in the vertical plane. This horn 2 flares out from a first open end 4 to a second open end 6 referred to as a «radiating aperture». The inside of the horn is filled with air. The radiating aperture 6 of the horn 2 is built into a metallic floorplan 8 and has an elongated shape.

Figure 2A:
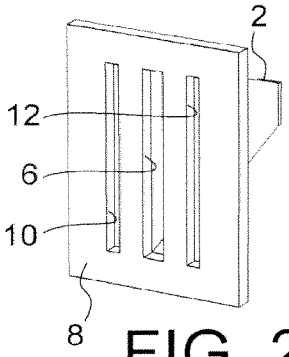
FIGS. 2A and 2B show the sectoral horn associated with the short-circuited radiating slots.
Figure 2B:
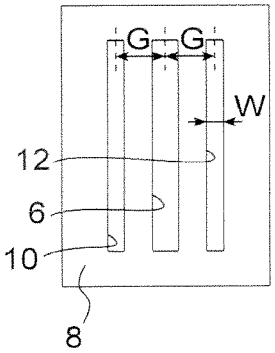

The half-power aperture of such a radiating source is very wide in the horizontal plane: it is about 130°. To reduce this aperture, short-circuited radiating slots 10, 12 (FIGS. 2A and 2B) are associated with the horn in order to produce a grating effect which focuses the radiation pattern in the horizontal plane and reduces the half-power aperture. These slots are built in the floorplan 8. They have an elongated shape and are disposed on either side of the radiating aperture 6, parallel thereto. They are short-circuited by means of a metallic cover (not represented), located beneath the floorplan, and are supplied by coupling with the electromagnetic energy coming out from the radiating aperture 6 of the sectoral horn 2.

The depth of these slots 10, 12 is equal to a quarter of the wavelength λ, corresponding to the operating frequency F of the antenna. This enables the reactive energy of these slots to be minimised in order to maximise the radiation thereof.

The distance between the centre of the radiating aperture 6 and the centre of the short-circuited slot 10 or 12 is noted G. And the width of each slot 10 or 12 is noted W. In the given example, the distance G and the width W are respectively 85 mm and 28 mm. These values are optimised in order to limit phase shifting between the electromagnetic fields radiated by the aperture 6 of the horn 2 and by the slots 10 and 12.

Figure 3A:
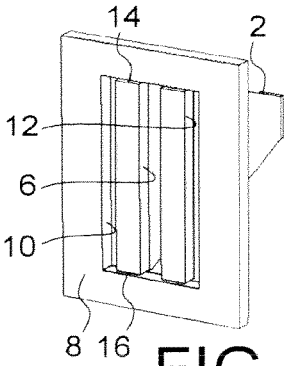
FIGS. 3A and 3B show grooves built between the radiating slots and the radiating aperture of the sectoral horn to promote the coupling.
Figure 3B:
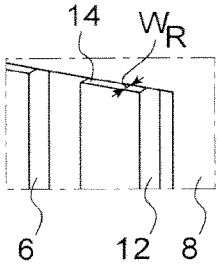

Coupling the electromagnetic energy of the aperture 6 of the horn 2 towards the slots 10 and 12 is further optimised thanks to grooves 14 and 16 (FIGS. 3A and 3B) being built into the floorplan 8. As can be seen, these grooves 14 and 16 are comprised between the slots 10, 12 and the aperture 6 and extend from the latter to the slots 10 and 12. Grooves 14 (respectively 16) extend from the top (respectively from the bottom) of the aperture 6 to the top (respectively to the bottom) of the slots 10 and 12.

The depth of the grooves 14 and 16 is identical to the one of the short-circuited slots 10 and 12. The width $W_R$ of these grooves has a limited size with respect to the wavelength λ, that is lower than 0.1λ (in the described example $w_R$ is 5 mm) in order to reduce the global size. The length of the short-circuited slots 10, 12 and of the aperture 6 of the sectoral horn is about 3 times the wavelength λ (corresponding to the operating frequency F).

Figure 4:
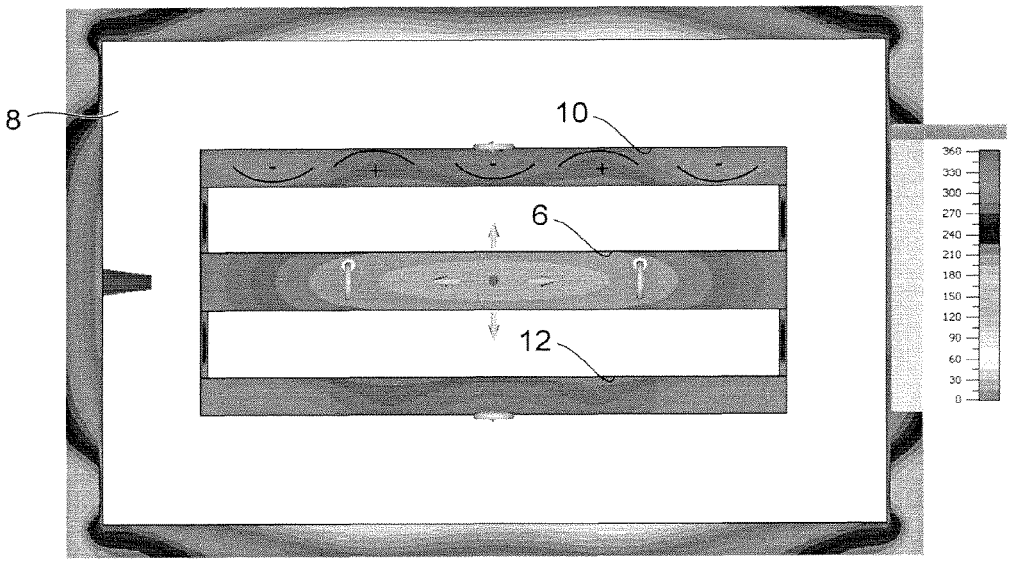
FIG. 4 shows the distribution of the phase of the electromagnetic field present in the radiating aperture of the sectoral horn as well as in the radiating slots.

This configuration results in a variable distribution of the phase in the slots 10 and 12. These variations can be seen in FIG. 4 which shows the distribution of the phase of the electromagnetic field present in the aperture 6 and in the slots 10 and 12. On the right of FIG. 4, the scale is graduated in degrees.

Figure 5A:
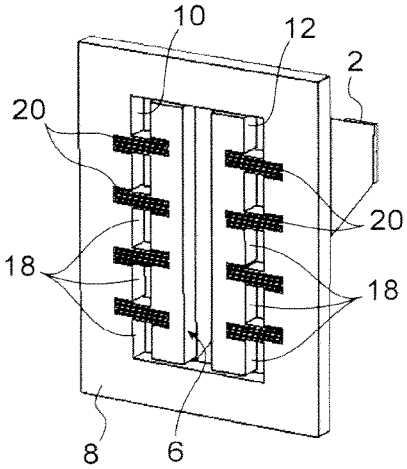
FIGS. 5A and 5B show the radiating slots divided into smaller slots, between which grooves are added.
Figure 5B:
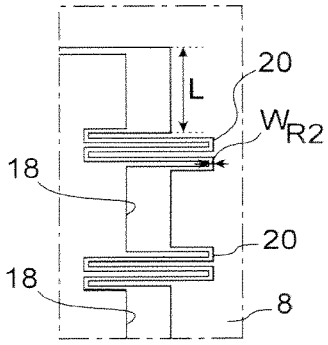

In order to ensure a constant distribution of the phase of the electromagnetic field in the radiating slots 10, 12 which are adjacent to the aperture 6 of the horn 2, these slots 10 and 12 are discretised by portions the length of which is a half-wave. More precisely, each radiating slot 10 or 12 is discontinuous and made up of a set of elongate elementary slots 18 (FIGS. 5A and 5B), spaced from each other. And the length L of each elementary slot 18 is substantially equal to λ/2.

Moreover, further grooves 20 (FIGS. 5A and 5B) are built into the floorplan 8, between these elementary slots 18. These further grooves 20 connect the elementary slots 18 of a same slot 10 or 12 to each other. The depth of these further grooves 20 is substantially a quarter of the wavelength λ (corresponding to the operating frequency F). The width $W_{R2}$ of these further grooves 20 is 3 mm in the example and the total length of each groove 20 is substantially 1.5λ. In the example, this length equal to 1.5λ is obtained by giving the grooves 20 a zigzag configuration.

Figure 6:
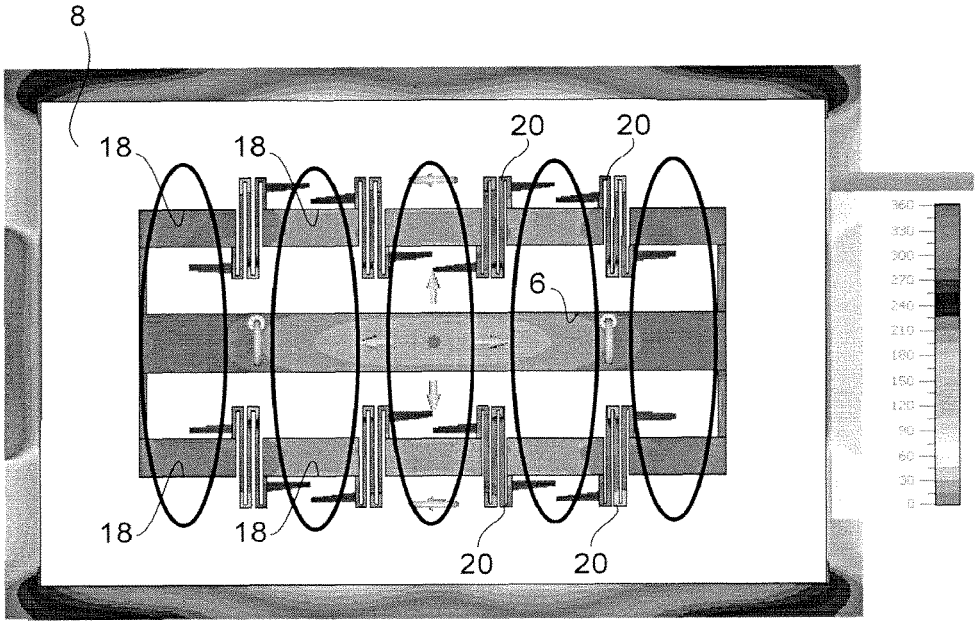
FIG. 6 is an illustration of an identical phase distribution in each area corresponding to a smaller slot.

This length provide the necessary correction such that the phase distribution of the electromagnetic fields radiated by the elementary slots 18 is the same for each of them as illustrated in FIG. 6 where the scale located on the right is graduated in degrees.

Associating and arranging, using the grooves 14, 16 and 20, the short-circuited slots with the sectoral horn enable the half-power aperture of the radiation pattern to be reduced to a value of 30° in the horizontal plane.

The system for reconfiguring the radiation pattern with which the antenna is provided is now considered.

Figure 7A:
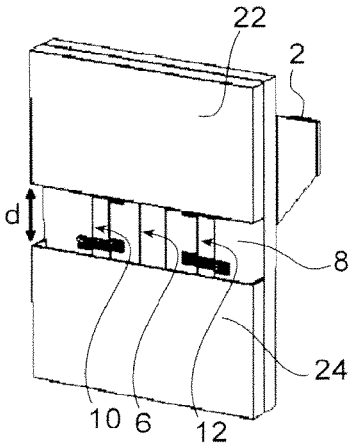
FIGS. 7A, 7B and 7C show louvres positioned above the radiating slots and the radiating aperture of the sectoral horn for three gap configurations of the louvres.
Figure 7B:
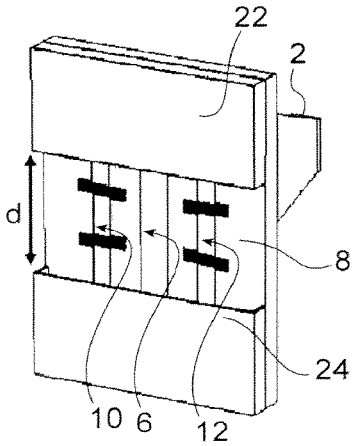
Figure 7C:
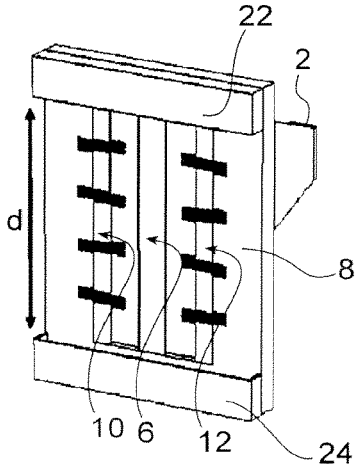

In order to obtain the variation of this radiation pattern in the vertical plane, parasitic elements are disposed above the radiating aperture 6 and above the radiating slots 10, 12. These elements are metallic louvres 22 and 24, which can be mechanically deployed, in a continuous manner, and located at 3 cm above the floorplan 8 (FIGS. 7A, 7B and 7C).

Louvres 22 and 24 can be made as telescopic louvres which are fixed to the floorplan 8.

The distance variation d between the louvres 22 and 24 provokes the variation of the half-power aperture of the radiation pattern in the vertical plane. FIGS. 7A, 7B and 7C respectively correspond to three gap configurations of louvres 22 and 24: d=0.8λ, d=1.6λ and d=3.3λ.

Table 1 below comprises a few values of the half-power aperture in the vertical plane and in the horizontal plane as a function of distance d.

TABLE 1

| d | 107.5 mm | 205 mm | 302.5 mm | 400 mm |
|---|---|---|---|---|
| Vertical aperture in the radiation pattern | 70.3° | 31.5° | 23.6° | 19° |
| Horizontal aperture in the radiation pattern | 26.5° | 32.5° | 31.5° | 30° |

Figure 8:
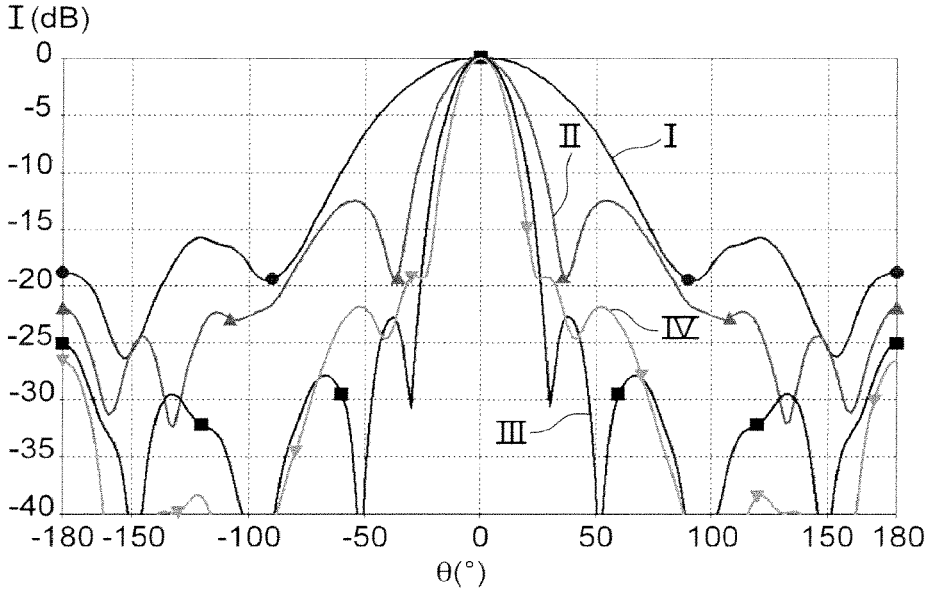
FIG. 8 shows theoretical radiation patterns in the vertical plane for several values of this gap.
Figure 9:
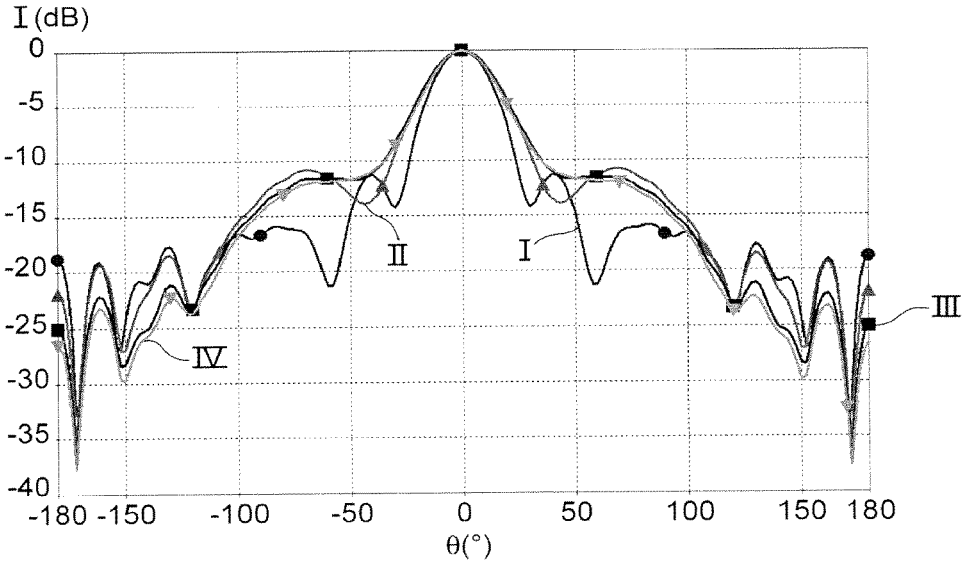
FIG. 9 shows theoretical radiation patterns in the horizontal plane for several values of this gap.

FIG. 8 (respectively FIG. 9) shows theoretical radiation patterns in the vertical (respectively horizontal) plane with several values of d: d=107.5 mm (curve I), d=205 mm (curve II), d=302.5 mm (curve III) and d=400 mm (curve IV). Intensity I (in dB) is plotted as a function of angle θ (in degrees).

The supply of antenna A is now considered.

Figure 10A:
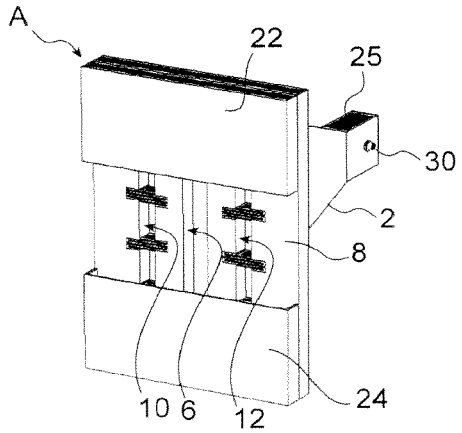
FIGS. 10A, 10B and 10C show a power supply of the antenna by a monopole antenna, introduced into a waveguide extending from the sectoral horn.
Figure 10B:
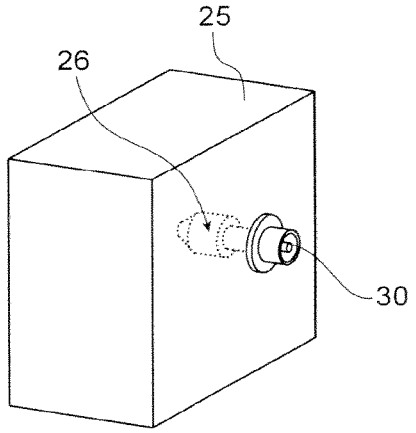
Figure 10C:
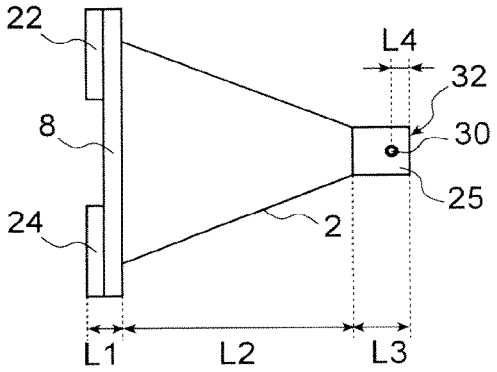

The end of the sectoral horn 2, which is opposite the radiating aperture 6 in the floorplan 8, extends into a short-circuited rectangular waveguide 25 (FIGS. 10A, 10B and 10C). The latter has a standard size for an operation at 2.47 GHz (43 mm high and 86 mm wide). A monopole antenna 26 is introduced into this waveguide in order to supply antenna A. The monopole antenna is welded on a connector N referenced 30, to be supplied by a coaxial cable not being represented. And the waveguide 25 is closed by a short-circuit 32.

In FIG. 10C, the lengths L1, L2, L3 and L4 are respectively 64 mm, 392 mm, 99 mm and 32 mm.

Figure 11:
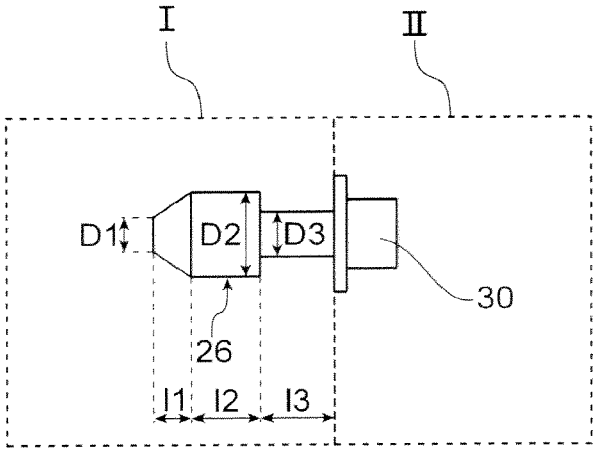
FIG. 11 shows the monopole antenna supplying the waveguide, with all the corresponding dimensions.

The various dimensions related to the monopole antenna 26 are noted in FIG. 11. Part I (respectively II) of FIG. 11 corresponds to what is inside (respectively outside) the waveguide 25. In FIG. 11, the diameters noted D1, D2 and D3 are respectively 6 mm, 14.5 mm and 11.5 mm and the lengths noted 11, 12 and 13 are respectively 6 mm, 11 mm and 11.5 mm.

The simulated adaptation of antenna A is lower than −14 dB for any value of gap d. The gain obtained in simulation varies from 11 to 16.5 dBi. The highest gain is obtained when the half-power aperture in the vertical plane is the most reduced.

Figure 12A:
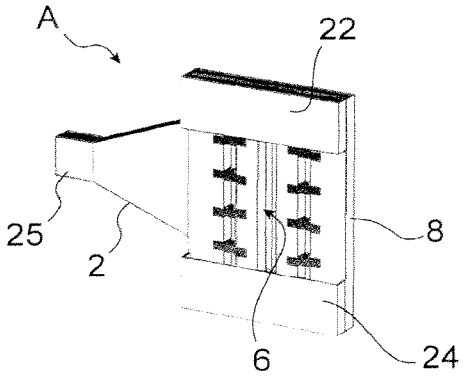
FIGS. 12A, 12B and 12C show another exemplary antenna with a reconfigurable pattern, in which the sectoral horn is folded.
Figure 12B:
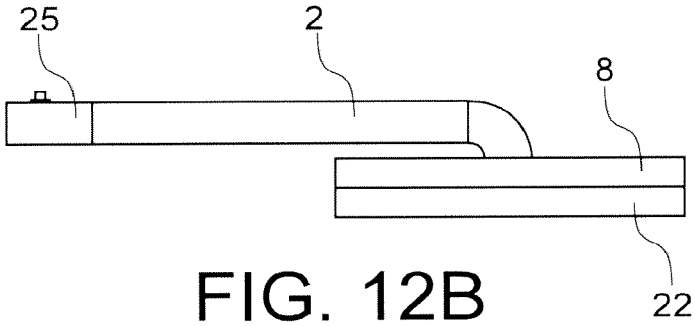
Figure 12C:
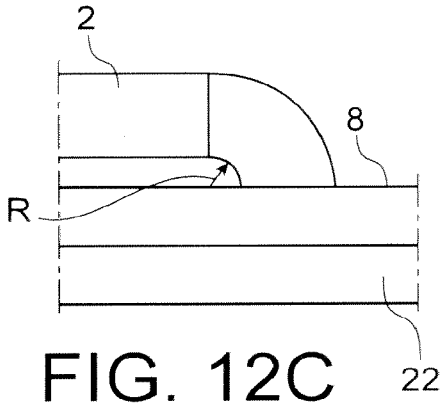

A particular embodiment of antenna A enabling the global size thereof to be reduced will be described thereafter (FIGS. 12A, 12B and 12C).

In order to keep a suitable global size for this antenna A, the sectoral horn 2 is folded in order for it to be «pressed» against the floorplan 8. The minimum radius of curvature noted R in FIG. 12C is 10 mm. If this radius is not respected, the phase distribution of the electromagnetic field present in the aperture 6 of the horn 2 is no longer constant. In this case, the radiation pattern is less focused and the half-power aperture in the vertical plane increases. It is then nearly impossible to keep an angle of 20°, even with a distance d of 400 mm.

The steps of an exemplary method for manufacturing the antenna A are given below.

1. Machining the floorplan 8.

The aperture 6 of the horn 2, the radiating slots 10 and 12 as well as all the grooves 14 and 16 are drawn with a water jet in the solid metal.

2. Machining the sectoral horn 2 and the short-circuited waveguide 25.

Two symmetrical parts of the set made up by this horn 2 and this waveguide 25 are made and both these parts are later assembled.

3. Adding a metallic cover under the floorplan 8, this cover enabling the slots 10 and 12 to be short-circuited.

The fingerprint of the aperture 6 of the horn 2 is machined in the cover.

4. Fastening the sectoral horn 2 and the waveguide 25 on the set made up by this cover and the floorplan 8.

5. Making the monopole antenna 26 welded on the connector N 30.

6. Fastening (by screwing) the connector N 30 and the monopole antenna 26 on the set formed by the horn 2 and the waveguide 25.

7. Making the louvres 22 and 24 as telescopic louvres and fastening them on the floorplan 8.

The invention claimed is:

1. An antenna with a reconfigurable radiation pattern, having a predetermined operating frequency, corresponding to a predetermined wavelength, the antenna comprising:

an electrically conductive floorplan;

an electrically conductive sectoral horn, including first and second open ends and flaring out from the first to the second open end, the second open end being built into the floorplan and having an elongated shape;

short-circuited radiating slots, having an elongated shape, built into the floorplan, disposed on either side of the second open end, parallel thereto; and electrically conductive louvres, disposed above the slots and the second open end, and configured to be mechanically deployed in a continuous manner to modify a radiation pattern of the antenna.

2. The antenna according to claim 1, wherein the slots have a depth substantially equal to a quarter of the predetermined wavelength.

3. The antenna according to claim 1, wherein the slots and the second open end have a length substantially equal to three times the predetermined wavelength.

4. The antenna according to claim 1, further comprising first grooves in the floorplan, between the radiating slots and the second open end.

5. The antenna according to claim 4, wherein the radiating slots and the first grooves substantially have a same depth.

6. The antenna according to claim 1, wherein each radiating slot is discontinuous and includes a set of elongated elementary slots, spaced from each other.

7. The antenna according to claim 6, wherein the length of each elementary slot is substantially equal to half the predetermined wavelength.

8. The antenna according to claim 6, further comprising second grooves in the floorplan, the second grooves connecting the elementary slots of a same radiating slot to each other.

9. The antenna according to claim 8, wherein each of the second grooves has a length substantially equal to 1.5 times the predetermined wavelength.

10. The antenna according to claim 8, wherein the second grooves have a depth substantially equal to a quarter of the predetermined wavelength.

11. The antenna according to claim 1, wherein the sectoral horn is folded and has a minimum radius of curvature, selected to maintain substantially constant distribution of a phase of the electromagnetic field present in the second open end of the sectoral horn.

* * * * *